US006112780A

United States Patent [19]

Meheen

[11] Patent Number: 6,112,780

[45] Date of Patent: Sep. 5, 2000

[54] 4-TUBE APPARATUS FOR GASEOUS CONTAMINANT CONTROL DURING BOTTLING PROCESSES

[76] Inventor: David M. Meheen, 411 W. Columbia St., Pasco, Wash. 99301

[21] Appl. No.: 09/160,211

[22] Filed: Sep. 23, 1998

Related U.S. Application Data

[63] Continuation-in-part of application No. 09/055,177, Apr. 3, 1998, abandoned.

[51] Int. Cl.[7] ..... B65B 31/00

[52] U.S. Cl. ..... 141/40; 141/48; 141/49; 141/54; 141/56; 141/64; 141/70; 141/6

[58] Field of Search ..... 141/39, 40, 47–50, 141/54, 56, 59, 63, 64, 70, 6, 7

[56] References Cited

U.S. PATENT DOCUMENTS

| | | | |
|---|---|---|---|
| 2,267,744 | 12/1941 | Nordquist | 141/70 |
| 2,754,043 | 7/1956 | Casigliani | 141/48 |
| 2,854,039 | 9/1958 | Boyd et al. | 141/70 |
| 3,088,831 | 5/1963 | Fauth et al. | 141/70 |
| 3,381,723 | 5/1968 | Quest | 141/64 |
| 3,478,785 | 11/1969 | Mallrich et al. | 141/39 |
| 3,633,635 | 1/1972 | Kaiser | 141/40 |
| 3,782,427 | 1/1974 | Zeimet et al. | 141/39 |
| 4,201,249 | 5/1980 | Borstelman | 141/39 |
| 4,342,344 | 8/1982 | Ahlers | 141/39 |
| 4,938,261 | 7/1990 | Petri et al. | 141/39 |
| 4,976,295 | 12/1990 | Clusserath | 141/39 |
| 5,054,527 | 10/1991 | Rozier | 141/39 |
| 5,163,487 | 11/1992 | Clusserath | 141/39 |
| 5,273,082 | 12/1993 | Paasche et al. | 141/39 |
| 5,924,462 | 7/1999 | McKaughan | 141/39 |

*Primary Examiner*—J. Casimer Jacyna
*Attorney, Agent, or Firm*—Reidlaw, L.L.C.; John S. Reid

[57] ABSTRACT

A four-tube bottling system that greatly reduces the oxygen or other air-borne contaminants in bottled beverages. The apparatus allows for the injecting of inert gas into the bottom of the container while the atmosphere escapes through the forth tube near the top of the container. With this method the air in the container is eliminated before the liquid is poured. This apparatus virtually eliminates contaminants from contact with the beverage during the filling process by purging existing atmosphere form the bottle.

10 Claims, 9 Drawing Sheets

(PRIOR ART)

4-TUBE APPARATUS FOR GASEOUS CONTAMINANT CONTROL DURING BOTTLING PROCESSES

This application is a continuation in part of U.S. patent application Ser. No. 09/055,177, filed on Apr. 3, 1998, now abandoned.

FIELD OF THE INVENTION

The present invention relates generally to an improved beverage bottle and container filling system which increases the amount of atmospheric gases, particularly oxygen, that can be purged from bottles during the bottling process.

BACKGROUND OF THE INVENTION

Since beverages have been bottled the oxygen that remains in the beverage after bottling has been a concern. Oxygen remaining in the beverage has several deleterious affects. For example, higher oxygen content left in beer and wine degrades the palatability and reduces shelf life. Consequently, over the years there has been an increased interest in finding a means to reduce the oxygen that remains in a bottled beverage.

Inert gases such as $N_2$ and $CO_2$ are used not only to reduce oxygen, or other contaminant content, but is also an aid in dispensing the beverage by supplying pressure for dispensing the contents of the container.

While the bottling process has evolved to the point where a substantial portion of the oxygen has been removed, the remaining oxygen in the beverage is still a substantial concern. Specifically, concerning shelf life and flavor. It would therefore be beneficial to have a means to reduce the amount of oxygen that remains after the bottling process is completed. Additionally, under the current methods of bottling a small amount of beverage is lost. This is not only a financial loss to the bottler, but also creates a disposal problem, which causes more financial loss. It would therefore be beneficial to eliminate the need for the collection of waste beverage as an by-product of eliminating contaminate gases.

SUMMARY OF THE INVENTION

The instant invention is an improved bottle, or other type of container, filling apparatus which reduces the amount of oxygen that remains in the container after and during the bottling process and does away with the need for a waste collection tank. Additionally, the pour of beverages is calmer thereby keeping a larger portion of the desired gases in place.

The apparatus is a four-tube embodiment of the three-tube filling apparatus that is used with conventional bottling equipment. First, the bottle is positioned below the filling assembly. The filling assembly is then lowered so that the tip of the fill tube proceeds through the bottle opening to the immediate vicinity of the bottom of the bottle. While lowering purge gas is introduced into the bottle to drive out the atmosphere. The purge gas is injected through the space between the filling tube and the purge tube. This process continues until the filling tube is fully lowered. At the point of being fully lowered the sealing gasket comes into contact with the lip of the bottle thereby creating an air-tight seal. Purge gas continues to flow into the bottle, as the atmosphere from inside the bottle is allowed to escape through the fourth tube. Since purge gas is being introduced in the container the pressure within the container is increasing. The control unit senses the pressure in the container, and the position of the filling tube within the bottle.

Also, the pressure felt by the sealing gasket can be used as process progress data. From the period between commencement of the purge and the sealing of the bottle the purge gas will drive atmosphere gas from the bottle. For the period of time from when the beverage is poured into the bottle and filling is terminated the remaining atmospheric gases are exited from the container via the off-gas tube. At the termination of the fill process an optional pulse can be used to cause foaming of the beverage from the upper liquid level to the lip. This foaming drives out any remaining gases in the void space immediately below the cap. After the purge and filling or the pulse is complete the bottle is capped in the same manner as was used in a typical prior art method.

The subject matter of the present invention is particularly pointed out and distinctly claimed in the concluding portion of the specification. However, both the organization and method of operation, together with further advantages and objects thereof, may best understood by reference to the following description taken in connection with accompanying drawings wherein like reference characters refer to like elements.

DESCRIPTION OF THE PREFERRED EMBODIMENT

Figure 1:
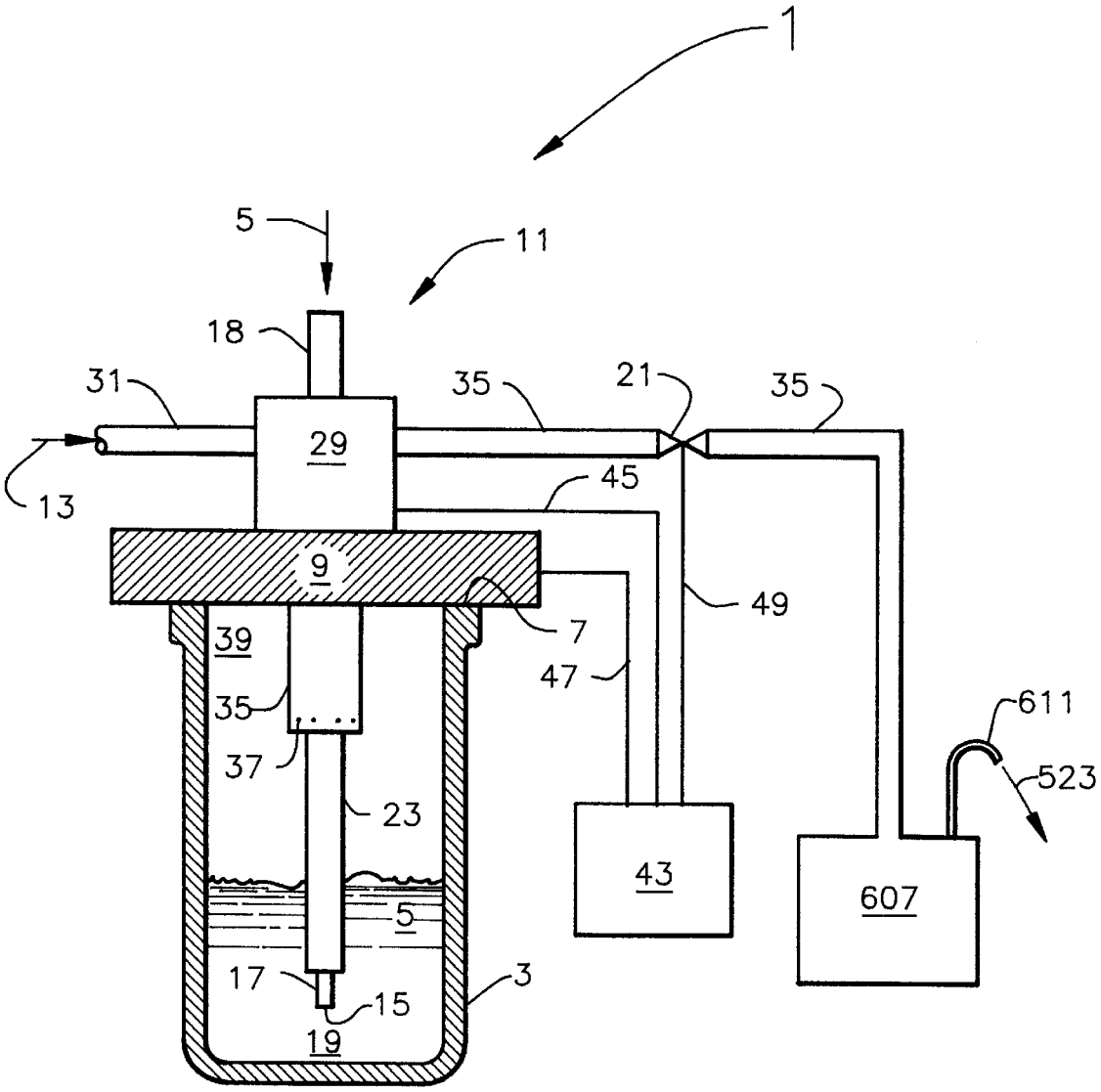
FIG. 1 is an schematic representation of the 3-Tube embodiment of the instant invention.
Figure 2:
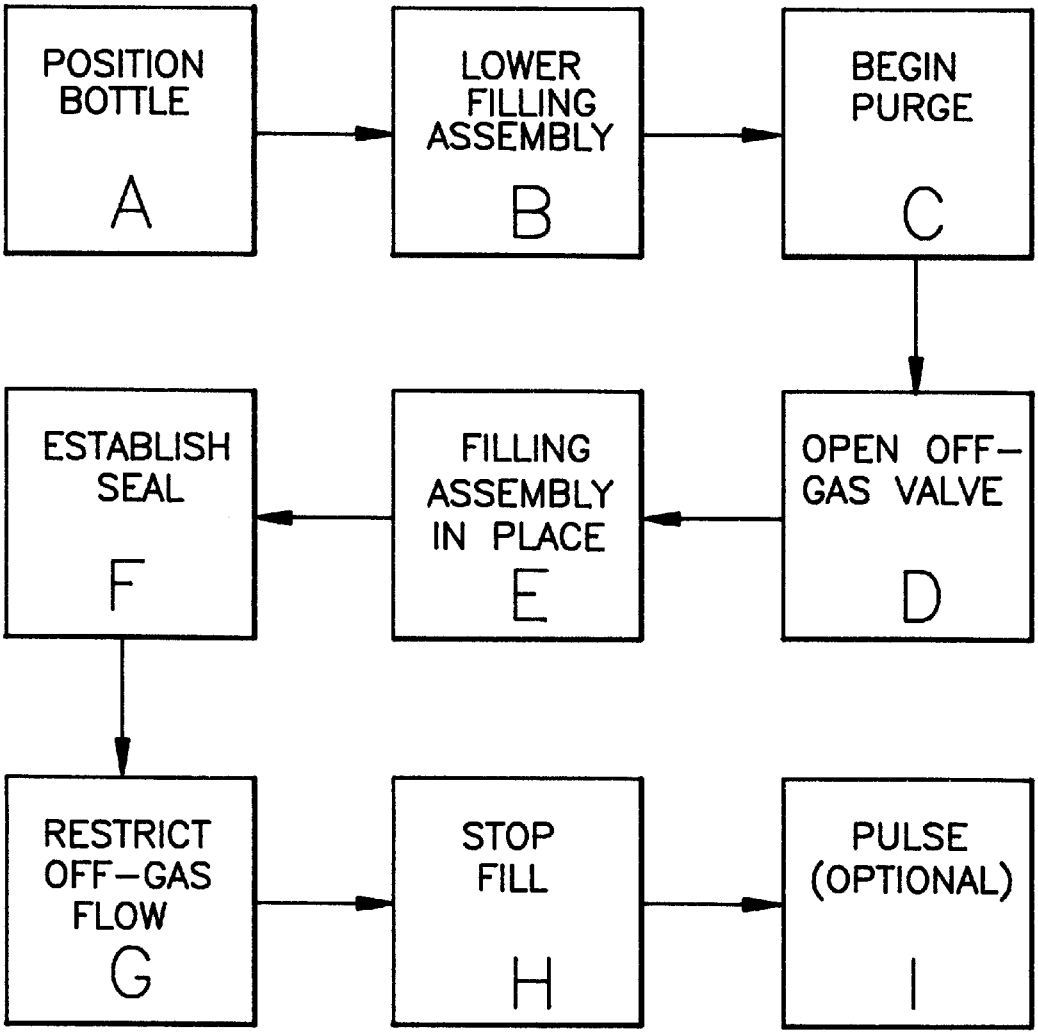
FIG. 2 is a flow chart illustrating the major events in sequence when utilizing the 3-Tube embodiment of the instant invention.

Referring to FIG. 1 and FIG. 2 the 3-Tube embodiment of the instant invention is an improved beverage bottle filling apparatus 1 which increases the amount of oxygen purged from containers or bottles 3 during the bottling process. Now referring to FIG. 6 the 4-Tube embodiment 2 is an improvement that has several distinct advantages over the 3-Tube embodiment 1. For example, the addition of the fourth tube 601 yields better product control, reduction in the waste of product, elimination for the need of a moisture separator 607, and less wasted product. The term "bottle" or "bottles" 3 is used herein to denote any container of a beverage 5 that has a lip 7 that is capable of holding an air-tight seal between the lip 7 and the sealing gasket 9. Both glass and metal containers 3 are contemplated, and these terms are used interchangeably. Examples of containers 3 that are specifically contemplated are: beer bottles; beer cans; soft drink cans; soft drink bottles; and wine bottles which are either corked and screwed on-capped; plastic containers; or crowned bottles.

Operational Steps of the 3-Tube Embodiment

Referring again to FIG. 1 and FIG. 2 the operation of the 3-Tube embodiment 1 consists of a series of sequential steps and begins by positioning A the bottle 3 below the filling assembly 11. The filling assembly 11 is then lowered B into the bottle 3 and is purged by introduction of purge gas 13 C and continues until the tip 15 of the beverage fill tube 17 reaches the vicinity 19 near the bottom of the bottle 3. During this phase of operations the off-gas valve 21 should be opened D. At the end of travel E a seal F is established between the lip of the bottle 7 and the sealing gasket 9. The control unit 43 or operator then restricts the flow of the off-gases 523 G to increase the pressure within the bottle to a pre-determined value. After fill is complete and pressure is stabilized H (at approximately atmospheric pressure in the case of soft drinks and beer) the bottle is capped. The art of capping or sealing the bottle or can is well known in the art and is not germane here. If desired an optional pulse I can be used to further reduce the amount of oxygen that remains in the beverage 5.

Operational Steps of the 4-Tube Embodiment

Figure 6:
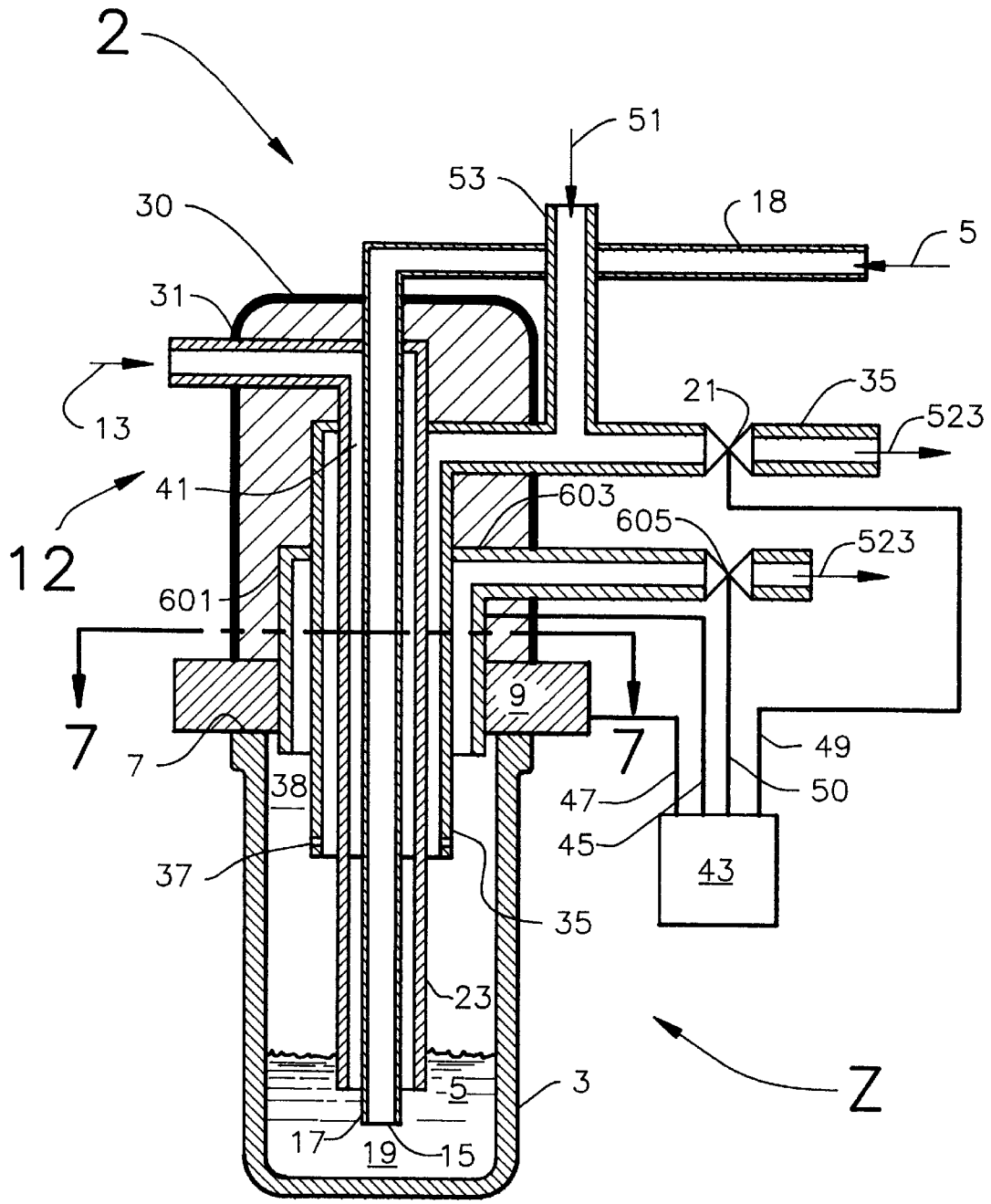
FIG. 6 is a cross-section that illustrates the gas flow paths for the 4-Tube embodiment of the instant invention during bottling.
Figure 8:
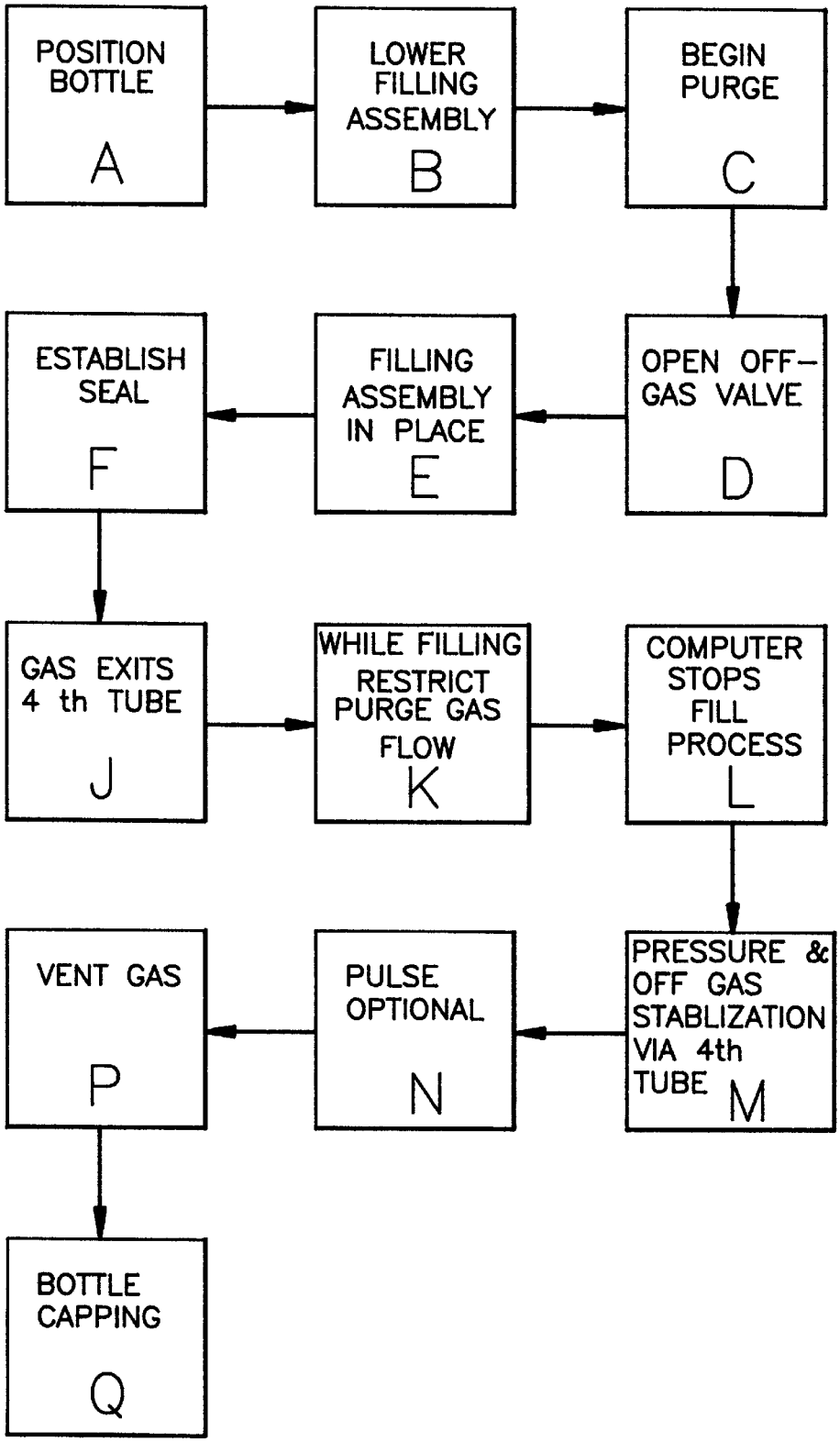
FIG. 8 is a flow chart illustrating the major events in sequence when utilizing the 4-Tube embodiment of the instant invention.

Now referring to FIG. 6 and FIG. 8 the operational steps A through F are the same in the 3-Tube 1 and the 4-Tube embodiments 2. However, in the 4-Tube embodiment purge gas 13 continues to exit the fourth tube 601 for a period of time to completely purge the bottle 3 of atmosphere J until valve 605 closes restricting purge of gas K and causing pressure to build in the bottle. The off-gas tube 35 will also have a valve 21 that is still in use with the 4-Tube embodiment. An additional connection 51 between the control unit 43 and the valve 605 is needed. When the correct pressure in the bottle is established the beverage 5 begins to flow and gas displaced by the incoming beverage 5 that is escaping through the off-gas tube 35.

Then the computer, or the operator, stops the fill process L. Waste is eliminated by stopping the fill process at this point since the beverage 5 does not exit via the waste gas tube 603. The remaining off-gas 523 then exits the forth tube 601 in step M. If desired an optional pulse N can be used to further reduce the amount of oxygen that remains in the beverage 5. After fill is complete and pressure is stabilized M the bottle is capped Q. The art of capping or sealing the bottle or can Q is well known in the art and is not germane here to any embodiment of the instant invention.

Filling Assembly of the 3-Tube Embodiment

Figure 3:
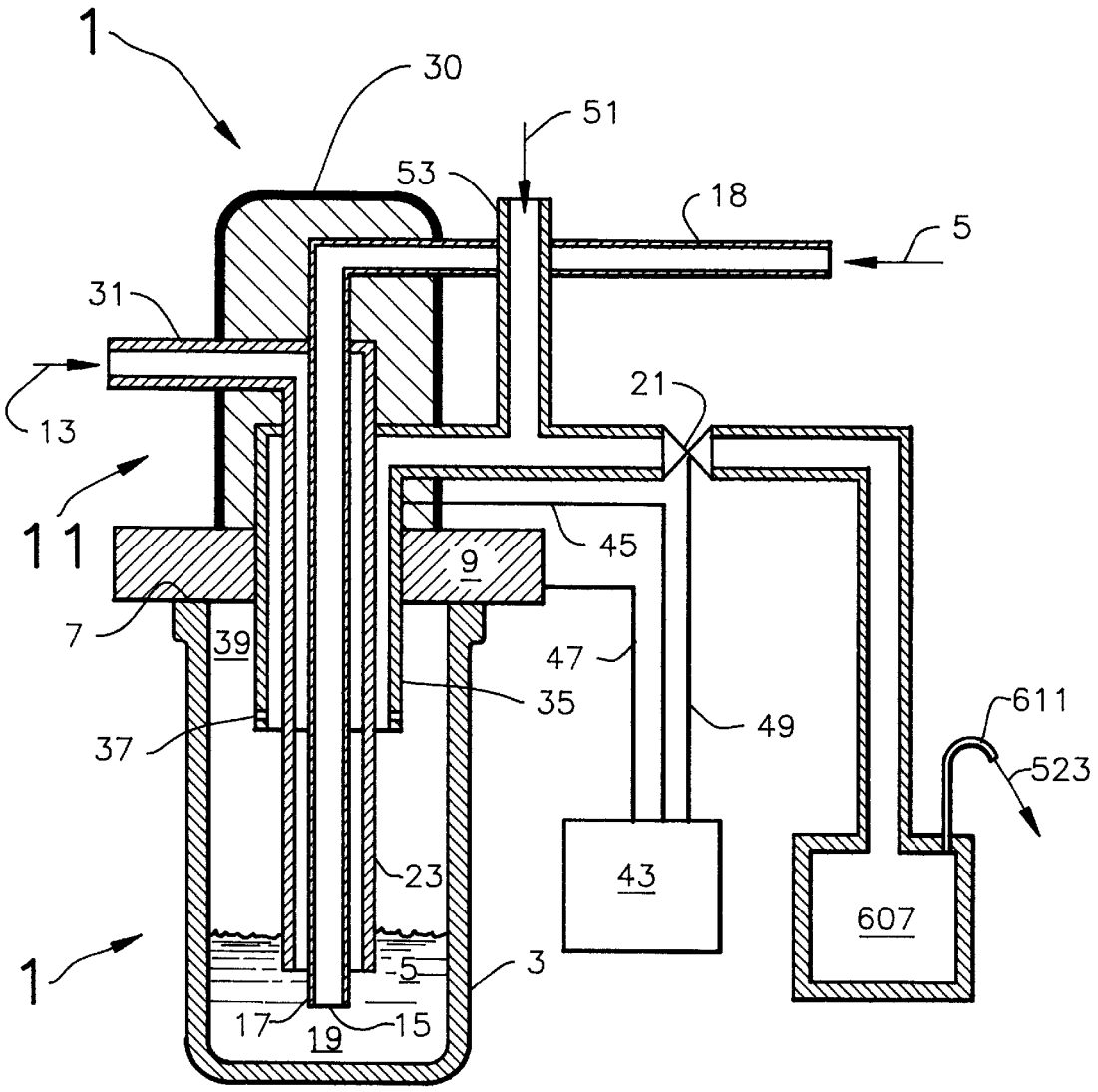
FIG. 3 is a cross-section that illustrates the gas flow paths for the 3-Tube embodiment of the instant invention during bottling.

Now referring to FIG. 1, FIG. 2 and FIG. 3 the filling assembly 11 refers to: the three-tubes, the beverage fill tube 17, purge tube 23, and off-gas tube 35 that protrudes into the bottle 3; the sealing gasket 9; and the filling head 29. It is customary for a multiplicity of filling assemblies 11 to be used simultaneously in a row or rotary configuration (not shown). The filing head 29 is a means to join the tubes and the gasket for ease of utilization.

The filling assembly 11 is communicably attached to a purge gas source and beverage source (not shown) via a purge gas source tube 31 and beverage supply tube 18 respectively. Clear plastic tubing has been the most efficient means due to its flexibility and ability of the operator to observe movement of the beverage 5. A purge gas source tube 31 (connected to the purge tube 23), a beverage supply tube 18 (attached to the beverage fill tube 17), and an off-gas exit tube 35 are attached to the filling head 29. Embodiments are contemplated wherein the pressures involved could necessitate metal tubing to achieve the required strength.

The off-gas tube 35 can have small openings 37 to increase the efficiency of the escape of the gases that are driven from the bottle 3. These openings are typically from 1 mm to 5 mm in size and can vary greatly.

After the bottle 3 is in position A the filling assembly 11 is lowered B so that the tip 15 of the beverage fill tube 17 proceeds through the bottle opening 39 to the immediate vicinity of the bottom 19 of the bottle 3.

It is advantageous to pour the beverage 5 into the bottom 19 of the container 3 because agitation of the beverage 5 causes any oxygen present to be absorbed more readily and acts to remove gases that were meant to be in the beverage 5. For example, carbonation which is the addition of $CO_2$ into the beverage 5 to produce a acidic ph in order to increase palpability, is removed by agitation.

As the beverage fill tube 17 is lowered into the bottom 19 of the bottle 3 a purge of the atmospheric gases is began by introducing C purge gas 13 into the space 41 between the beverage fill tube 17 and the purge tube 23. This process continues until the filling assembly 11 is fully lowered E in the bottle 3. The purging of atmospheric gases prior to filling prevents oxygen from coming into contact with the freshly poured beverage 5.

Purge gases 13 are typically $N_2$ or $CO_2$ that is readily commercially available to brewers and bottlers. However, the noble gases can be used for the bottling of more demanding conditions. Except for very valuable beverages or liquids noble gases should not be used due to low cost effectiveness. Additionally, liquids that need atmospheric control such as liquid sodium, ether, mercury can benefit from the use of this process.

At the point of being fully lowered E the sealing gasket 9 comes into contact with the lip 7 of the bottle 3 thereby creating an air-tight seal E. Purge gas 13 continues to flow into the bottle 3 and the atmosphere from inside the bottle 3 is allowed to escape through the off-gas tube 35. Since purge gas 13 is being introduced in the container 3 the pressure within the container 3 is increasing because the off-gas control valve 21 is either shut or partially shut. The off-gas control valve 21 position is controlled by either an operator or a control unit 43. If a control unit is used, there will be a link 49 between the control unit 43 and the off-gas control valve 21.

A control unit 43 senses both the pressure 45 within the container and the travel position 47 of the beverage fill tube 17, and the filling assembly 11, within the bottle 3. Also, the pressure felt by the sealing gasket 9, pressure inside the bottle 3, force applied to the sealing gasket 9 by the bottle 3, can all be used as process progress data. In lieu of a control unit 43, an operator can manually initiate and stop the various processes necessary to utilize the instant invention 1,2.

As mentioned above, the period between commencement of the purge and the sealing of the bottle 3, the purge gas 13 will drive atmospheric gases from the bottle 3. After the sealing F of the bottle 3, the purge will continue for a length of time while the remaining atmosphere from the bottle 3 is allowed to escape through the off-gas tube 35. The purge gas 13 will continue to flow into the bottle 3 until it reaches the desired pressure. Once the desired pressure is reached filling begins. When the bottle 3 is filled to the desired level, the fill is terminated and the bottle 3 capped (or corked or otherwise sealed). The instant invention 1 can also be used to pulse I the beverage 5 to cause foaming up to, the lip of the bottle 3.

Filling Assembly of the 4-Tube Embodiment

Now referring to FIG. 6 the 4-Tube filling assembly 12 refers to: the four tubes, the beverage fill tube 17, purge tube 23, and off-gas tube 35, and the fourth tube 601 that protrudes into the bottle 3; the sealing gasket 9; and the filling head 30.

It is customary for a multiplicity of 4-Tube filling assemblies 12 to be used simultaneously in a row or rotary configuration (not shown). The filing head 30 is a means to join the tubes and the gasket for ease of utilization.

The 4-Tube filling assembly 12 is communicably attached to a purge gas source and beverage source (not shown). Clear plastic tubing has been the most efficient means due to its flexibility and ability of the operator to observe movement of the beverage 5. A purge gas source tube 31 (connected to the purge tube 23), a beverage supply tube (attached to the beverage fill tube 17), and an off-gas exit tube (attached to the off-gas tube 35, not shown) are attached to the filling head 29. Embodiments are contemplated wherein the pressures involved could necessitate metal tubing to achieve the required strength.

The off-gas tube 35 can have small openings 37 to increase the efficiency of the escape of the gases that are driven from the bottle 3. These openings are typically from 1 mm to 5 mm in size and can vary greatly, and depends upon the flow rates required.

After the bottle 3 is in position A the filling assembly 12 is lowered B so that the tip 15 of the beverage fill tube 17 proceeds through the bottle opening 39 to the immediate vicinity of the bottom 19 of the bottle 3.

It is advantageous to pour the beverage 5 into the bottom 19 of the container 3 because agitation of the beverage 5 causes any oxygen present to be absorbed more readily and acts to remove gases that were meant to be in the beverage 5. For example, carbonation which is the addition of $CO_2$ into the beverage 5 to produce a acidic ph in order to increase palpability, is removed by agitation.

As the beverage fill tube 17 is lowered into the bottom 19 of the bottle 3 a purge of the atmospheric gases is began by introducing C purge gas 13 into the space 41 between the beverage fill tube 17 and the purge tube 23. This process continues until the filling assembly 12 is fully lowered E in the bottle 3. The purging of atmospheric gases prior to filling prevents oxygen from coming into contact with the freshly poured beverage 5.

Purge gas 13 is typically $N_2$ or $CO_2$ that is readily commercially available to brewers and bottlers. However, the noble gases can be used for the bottling of more demanding conditions. Except for very valuable beverages or liquids noble gases should not be used due to low cost effectiveness. Additionally, liquids that need atmospheric control such as liquid sodium, ether, mercury can benefit from the use of this process.

At the point of being fully lowered E the sealing gasket 9 comes into contact with the lip 7 of the bottle 3 thereby creating an air-tight seal E. Purge gas 13 continues to flow into the bottle 3 and the atmosphere from inside the bottle 3 is allowed to escape through the off-gas tube 35. Since purge gas 13 is being introduced in the container 3 the pressure within the container 3 is increasing because the off-gas control valve 21 is either shut or partially shut. The off-gas control valve 21 position is controlled by either an operator or a control unit 43. If a control unit is used, there will be a link 49 between the control unit 43 and the off-gas control valve 21.

A control unit 43 senses both the pressure 45 within the container and the travel position 47 of the beverage fill tube 17, and the filling assembly 12, within the bottle 3. Also, the pressure felt by the sealing gasket 9, pressure inside the bottle 3, force applied to the sealing gasket 9 by the bottle 3, can all be used as process progress data. In lieu of a control unit 43, an operator can manually initiate and stop the various processes necessary to utilize the instant invention.

As mentioned above, the period between commencement of the purge and the sealing of the bottle 3, the purge gas 13 will drive atmospheric gases from the bottle 3. After the sealing F of the bottle 3, the purge will continue for a length of time while the remaining atmosphere from the bottle 3 is allowed to escape through the fourth tube 601. Once the desired pressure is reached, pouring of the beverage continues until the bottle 3 is filled to the desired level and filing is terminated. Pressure is released form the bottle through the fourth tube 601 until the desired pressure is reached. Once the desired fill is reached the fill will be terminated and the bottle 3 capped (or corked or otherwise sealed). The instant invention 1 can also be used to pulse N the beverage 5 to cause foaming up to, the lip of the bottle 3.

Optional Pulse

Figure 4:
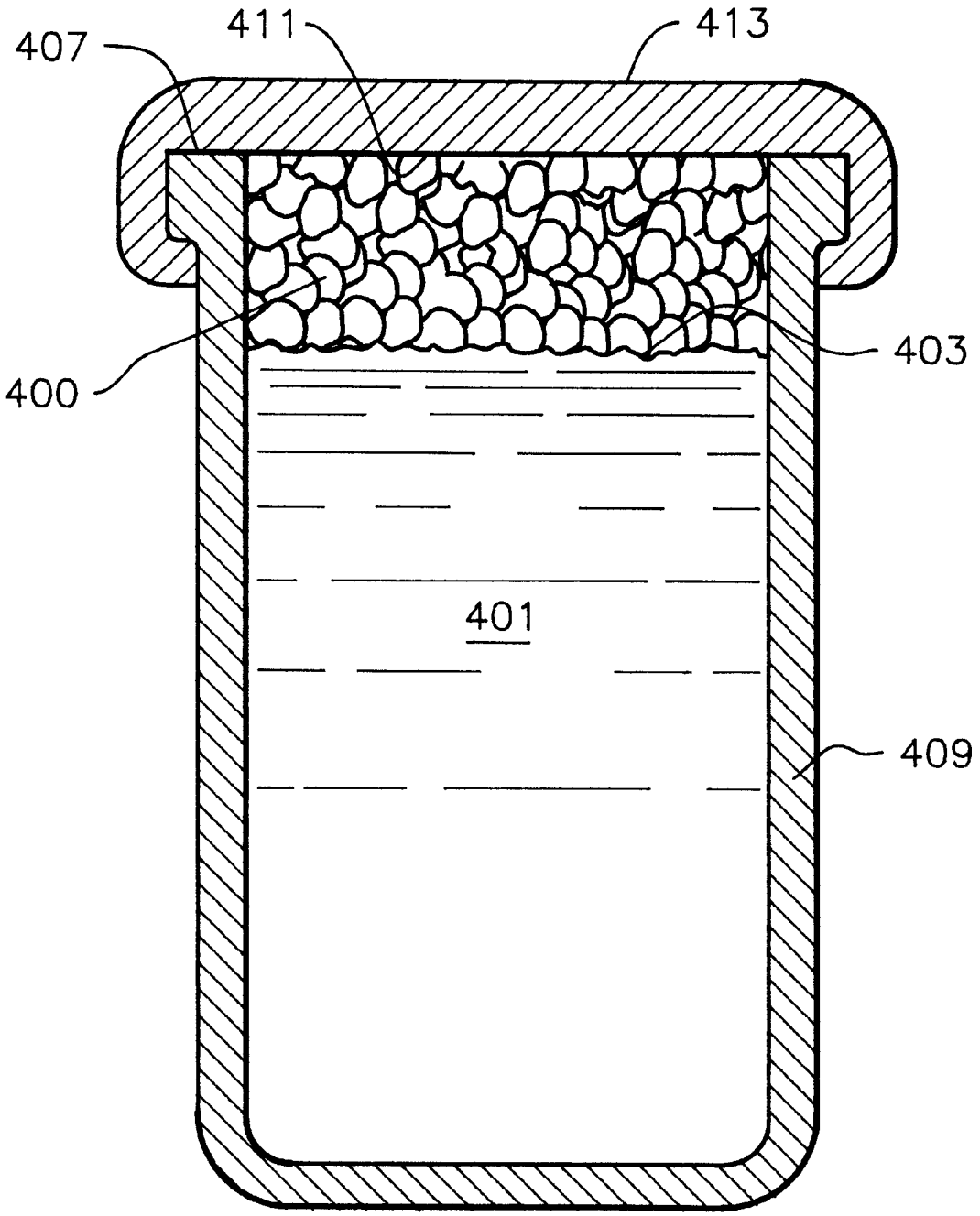
FIG. 4 is a cross-section of a filled and capped container that illustrates the foaming that results from the use of an inert gas pulse in either the 3-Tube or the 4-Tube embodiment of the instant invention.

Now referring to FIG. 4, at the termination of the fill process an optional pulse can be used to cause foaming 400 of the beverage 401 from the beverage surface 403 to the lip 407 of the bottle 409 which is typically also the under surface 411 of the bottling cap 413. This foaming drives out any remaining atmosphere in the region 415 from the beverage surface 403 to the bottom surface 405 of the cap 413. After capping the foam subsides and the remaining gases are substantially purge gas (not shown) with only residual traces of atmospheric gases.

Referring to FIG. 3 and FIG. 6 the purge gas pulse 51 is introduced into the off-gas tube 35 via a pulse tube 53. Now referring to FIG. 8 the purge gas pulse exits through the fourth tube 601 in step P.

Construction and Operational Considerations

Referring again to FIG. 1 after the removal of as much oxygen and atmospheric gases as possible the bottle 3 is capped in the same manner as was used in the prior art method or in the 3-Tube embodiment. The art of capping or corking is well known and is not germane to the point of novelty of the instant invention.

TUBING: As in prior art the filling heads 29,30 should be attached to the various gas supplies using flexible tubing due to the motion of the filling heads 29,30 relative to the bottle 3 and the support of the filling assembly (not shown). Also, rigid tubing can be used when necessary to support high pressure applications.

Figure 7:
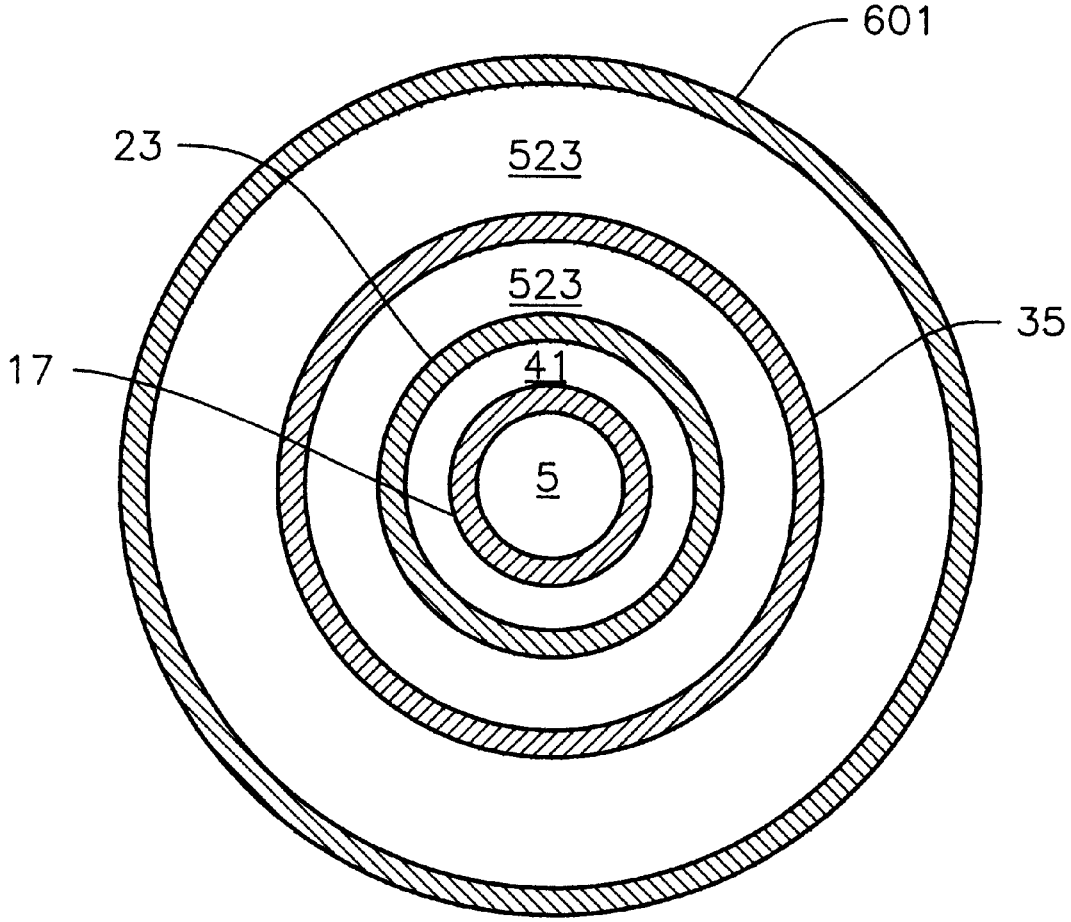
FIG. 7 is a cross-section along lines 7—7 that illustrates the relative position of the four tubes utilized the 4-Tube embodiment of the instant invention.
Figure 9:
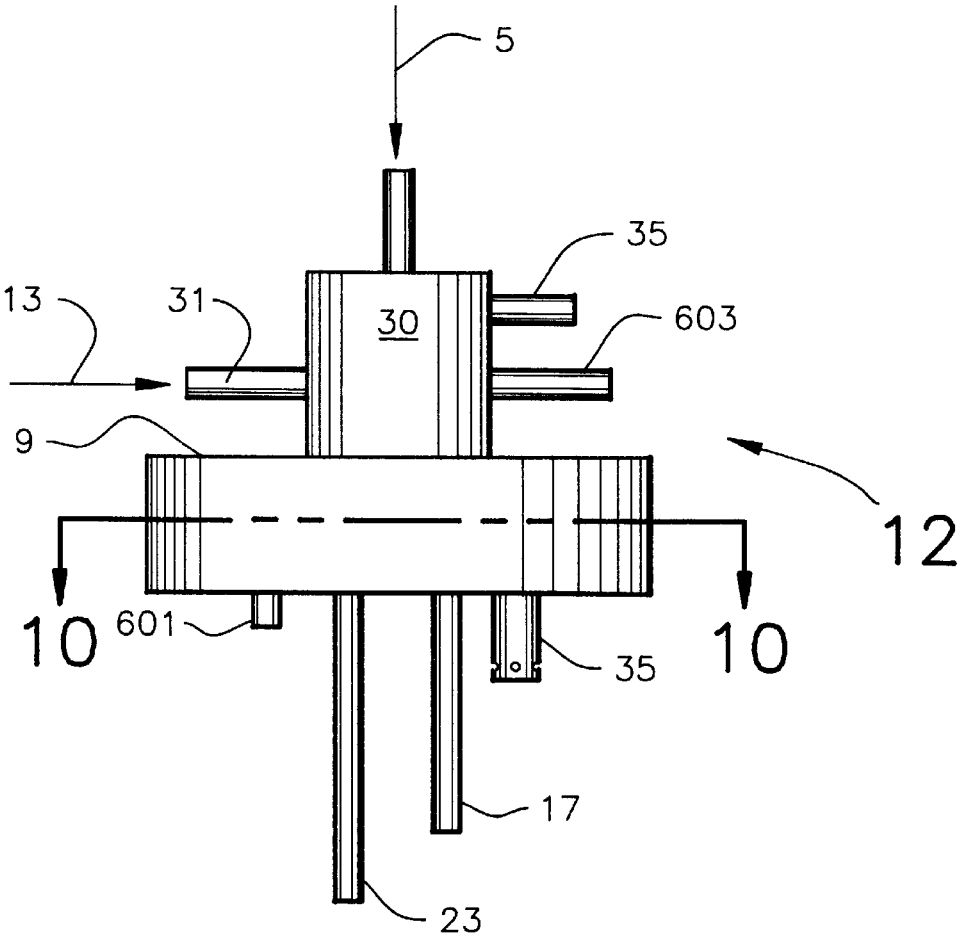
FIG. 9 is a side view of the instant invention in which the tubes are in the non-concentric configuration.
Figure 10:
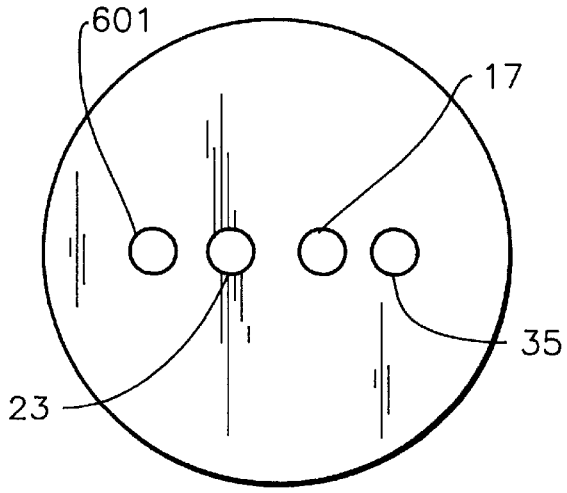
FIG. 10 is cross-sectional view along lines 10—10 that illustrates the placement of tubes in the non-concentric configuration.

TUBE ARRANGEMENT: Now referring to FIG. 7 the preferred embodiment for narrow opening bottles, such as glass beer and soft drink bottles, is a series of concentric tubes, one within the other. The typical beer or cola bottle has an opening of less than one inch. The use of concentric rings allows sufficient flow rates to achieve an economical fill rate of the bottles. Now referring to FIG. 9 and FIG. 10, in bottles with larger openings the tubes do not need to concentric. They can assume almost any geometric configuration. The configuration required is determined by the shape of the opening.

The filing heads 29,30 are typically constructed of rigid material to hold the tubes in places. Most liquid containers are cylinders with the height several times the diameter which requires the tubes to be long and thin.

RELATIVE MOTION: Other embodiments are also possible. For example, the bottle can be moved to the filling head.

CLOSEST PRIOR ART TO 3-TUBE EMBODIMENT

Figure 5:
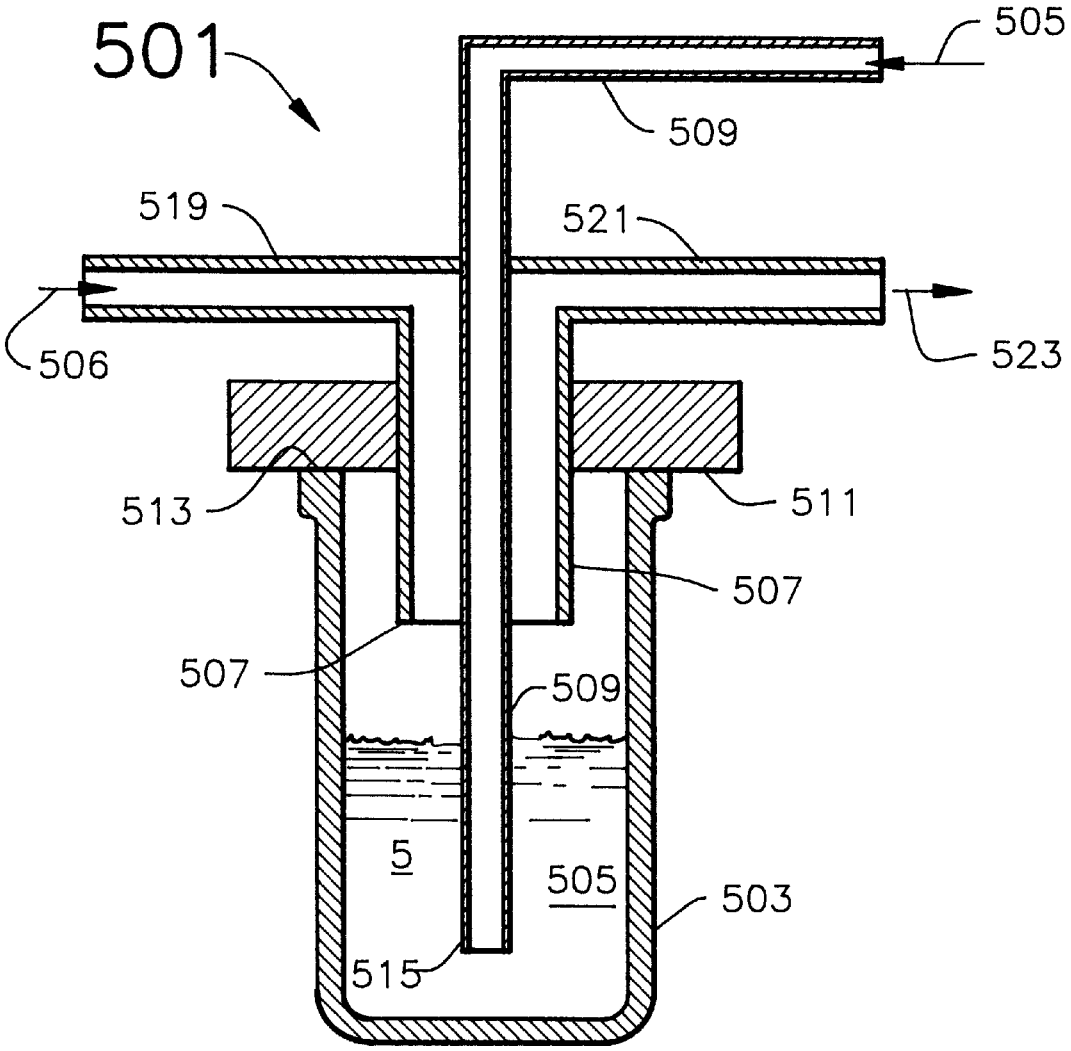
FIG. 5 is a cross-section that illustrates the gas flow paths for the prior art apparatus used during bottling.

Now referring to FIG. 5 the advantages of the three and four tube embodiments can best be understood when the operation of the closest invention in prior art is illustrated. Prior to the instant invention the applicant used a two-tube filling assembly 501 to fill the bottle 503 with beverage 505 while supplying purge gas 506.

The two-tube filling assembly 501 is comprised of an outer tube 507 and an inner tube 509 and the associated purge gas and beverage supply tubing (not shown). The tubes 507,509 are mounted within a seal gasket 511 that is lowered onto the lip 513 of the bottle 503. The tip 515 of the inner tube 509 is placed near the bottom 517 of the bottle 503 for the reasons stated above. The outer tube 507 has two branches: a purge gas inlet 519 and an off-gas branch 521.

The outer tube 507 both supplied purge gas 511 and acted as a path for removal of unused purge gas 506 and the atmospheric gases 523 (off-gases 523) that are driven from the bottle 503. The inner tube 509 was used only as a beverage fill tube.

When the two-tube filling assembly 501 is lowered into the bottle 503 purge gas 506 is introduced into the bottle 503 via the outer tube 507. Beverage 505 is then introduced into the bottle 503 via the inner tube 509. As in the instant invention, and most commercially available bottling machines, the pressure is increased by restricting the flow from the off-gas branch of the outer tube while supplying purge gas 506. After filling the bottle was capped utilizing conventional capping mechanisms.

EXPERIMENTAL DATA ILLUSTRATING THE OXYGEN REMOVAL ABILITY OF THE PREFERRED EMBODIMENT

Test were made to determine the approximate ability of the preferred embodiment to remove oxygen from the beverage bottle 3. Testing for both the prior art and the instant invention 1 were conducted using malt beverage delivered from a refrigerated and pressurized tank with an average $O_2$ content of 54.3 ppb dissolved in the liquid. All measurements were obtained using Orbisphere testing equipment.

First Experiment Results (Prior Art)

Referring to FIG. 5, the first experiment was conducted with the apparatus defined above as prior art as the means to remove gases from the bottle. Immediately after filling, each bottle was shaken for 3 minutes and the dissolved $O_2$ measured in parts per billion (ppb).

TABLE 1

| Prior Art | | |
|---|---|---|
| Time (minutes) | Temp (° C.) | Dissolved $O_2$ (ppb) |
| 0 | 10.13 | 245 |
| 1 | 8.90 | 274 |
| 3 | 8.80 | 250 |
| 4 | 9.50 | 310 |

Second Experiment Results (3-Tube Embodiment)

The second experiment was conducted utilizing the instant invention 1 as the means to remove gases from the bottle. In the same manner as the first, the bottles 3 were shaken for 3 minutes immediately after filling and $O_2$ measurements taken.

TABLE 2

| Instant Invention | | |
|---|---|---|
| Time (minutes) | Temp (° C.) | Dissolved $O_2$ (ppb) |
| 0 | 10.62 | 70 |
| 5 | 11.20 | 65 |
| 6 | 10.60 | 60 |
| 7 | 11.10 | 61 |
| 9 | 10.74 | 73 |

Now referring to FIG. 1 it is apparent from the above data a substantial reduction in oxygen content was achieved by the 3-Tube embodiment 1. Four-tube oxygen concentrations are relatively similar to the three-tube oxygen reading. Gas in the 3-Tube embodiment 1 must pass through a combination moisture separator and waste tank 607 and exit through a vent 611.

Now referring to FIG. 6 the instant invention not only has the substantial reduction in oxygen but vents the off-gas tube 35 directly to the atmosphere.

OTHER EMBODIMENTS POSSIBLE

While several embodiments of the present invention have been shown and described, it will be apparent to those skilled in the art that many changes and modifications may be made without departing from the invention in its broader aspects.

I claim:

1. A filling apparatus for filling bottles which have a lip defining a bottle opening, the filling apparatus comprising:

a filling head configured for sealing engagement with the lip of the bottle;

a fill tube supported by the filling head and configured to be introduced into the bottle opening such that the beverage fill tube substantially protrudes into the bottle during sealing engagement of the filling head and the lip of the bottle, and further configured to selectively convey fluid through the filling head during sealing engagement of the filling head and the lip of the bottle;

a purge tube supported by the filling head and which circumscribes at least a portion of the fill tube forming a substantially annular passage there between and which is shorter than the fill tube and is configured to be introduced into the bottle opening such that the purge tube substantially protrudes into the bottle during sealing engagement of the filling head and the lip, and further configured to selectively convey fluid through the filling head during sealing engagement of the filling head and the lip of the bottle; and, an off-gas tube supported by the filling head and which circumscribes at least a portion of the purge tube forming an annular passage there between and which is shorter than the purge tube and is configured to be introduced into the bottle opening such that the off-gas tube substantially protrudes into the bottle during sealing engagement of the filling head and the lip, and further configured to selectively convey fluid through the filling head during sealing engagement of the filling head and the lip of the bottle.

2. A filling apparatus for filling bottles which have a lip defining a bottle opening, the filling apparatus comprising:

a filling head configured for sealing engagement with the lip of the bottle;

a fill tube supported by the filling head and configured to be introduced into the bottle opening such that the fill tube substantially protrudes into the bottle during sealing engagement of the filling head and the lip of the bottle;

a purge tube supported by the filling head and configured to be introduced into the bottle opening such that the purge tube substantially protrudes into the bottle during sealing engagement of the filling head and the lip;

an off-gas tube supported by the filling head and configured to be introduced into the bottle opening such that the off-gas tube substantially protrudes into the bottle during sealing engagement of the filling head and the lip;

a fourth tube supported by the filling head and configured to be introduced into the bottle opening such that the fourth tube substantially protrudes into the bottle during sealing engagement of the filling head and the lip;

wherein the fill tube, the purge tube, and the off-gas tube are configured to protrude into the bottle simultaneously during sealing engagement of the filling head and the lip; and, wherein:

the fill tube is longer than the purge tube;

the purge tube is longer than the off-gas tube; and, the off-gas tube is longer than the fourth tube.

3. The filling apparatus of claim 2, and wherein the fill tube, the purge tube, the off-gas tube, and the fourth tube are each configured to selectively convey a fluid through the filling head when the filling head during sealing engagement of the filling head and the lip.

4. The filling apparatus of claim 2, and wherein the off-gas tube defines a plurality of small radial openings therein and which are configured so as to be inside the bottle during sealing engagement of the filling head and the lip.

5. The filling apparatus of claim 2, and wherein the fill tube, the purge tube, the off-gas tube, and the fourth tube are substantially coaxial with one another.

6. The filling apparatus of claim 5, and wherein:

the fourth tube at least partially circumscribes the off-gas tube;

the off-gas tube at least partially circumscribes the purge tube; and, the purge tube at least partially circumscribes the fill tube.

7. A method of filling bottles which have a lip defining a bottle opening, the method comprising:

providing a filling head configured for sealing engagement with the lip of the bottle;

providing a fill tube which is supported by the filling head;

providing a purge tube which is supported by the filling head and which is configured to protrude into the bottle during sealing engagement of the filling head and lip, and which is shorter than the fill tube;

providing an off-gas tube which is supported by the filling head and which is configured to protrude into the bottle during sealing engagement of the filling head and lip, and which is shorter than the purge tube;

providing a fourth tube which is supported by the filling head and which is configured to protrude into the bottle during sealing engagement of the filling head and lip, and which is shorter than the off-gas tube;

moving the filling head with respect to the bottle such that the fill tube and the purge tube protrude into the bottle;

introducing a purge gas into the bottle through the purge gas tube;

moving the filling head into sealing engagement with the lip;

introducing liquid into the bottle through the fill tube so as to fill the bottle to a given level; and, selectively releasing the purge gas and atmospheric gas through the off-gas tube and through the fourth tube during the filling thereof.

8. The method of claim 7, and further comprising:

introducing at least one pulse of gas into the bottle through the off-gas tube after the filling thereof and during sealing engagement of the filling head with the lip.

9. The method of claim 8, and further comprising:

selectively releasing pressure from the bottle through the fourth tube after introducing at least one pulse of fluid into the bottle and during sealing engagement of the filling head and lip.

10. The method of claim 8, and wherein the pulse of gas is a pulse of the purge gas.

* * * * *